US007015680B2

(12) United States Patent
Moraveji et al.

(10) Patent No.: US 7,015,680 B2
(45) Date of Patent: Mar. 21, 2006

(54) CURRENT-LIMITING CIRCUITRY

(75) Inventors: Farhood Moraveji, Saratoga, CA (US); Behzad Mohtashemi, San Jose, CA (US)

(73) Assignee: Micrel, Incorporated, San Jose, CA (US)

( * ) Notice: Subject to any disclaimer, the term of this patent is extended or adjusted under 35 U.S.C. 154(b) by 84 days.

(21) Appl. No.: 10/867,549

(22) Filed: Jun. 10, 2004

(65) Prior Publication Data

US 2005/0275394 A1 Dec. 15, 2005

(51) Int. Cl.
*G05F 1/569* (2006.01)

(52) U.S. Cl. ..... 323/274; 323/276; 323/316; 323/908

(58) Field of Classification Search ..... 323/274, 323/275, 276, 277, 279, 280, 313, 314, 316, 323/908
See application file for complete search history.

(56) References Cited

U.S. PATENT DOCUMENTS 5,731,692 A * 3/1998 Garcia ..... 323/274
5,821,740 A * 10/1998 Hodgins et al. ..... 323/277
6,496,345 B1 * 12/2002 Smith ..... 323/277

* cited by examiner

*Primary Examiner*—Jessica Han
(74) *Attorney, Agent, or Firm*—Bever, Hoffman & Harms, LLP; Patrick T. Bever

(57) ABSTRACT

A field effect transistor (FET) driver circuit includes an error amplifier for providing a FET control signal and a current limiting amplifier for preventing excessive current flow through the FET. The current limiting amplifier generates an overcurrent signal when an excessive current is detected. In response to the overcurrent signal, a voltage control circuit adjusts the voltage at the output of the error amplifier to turn off the FET. Meanwhile, a pulldown circuit at an input of the error amplifier adjusts the voltage provided to that input to cause the error amplifier to provide an output voltage that also tends to turn off the FET. If a buffer is present at that input to the error amplifier, a second pulldown circuit is placed at the input to the buffer to maintain a stable unity gain across the buffer.

19 Claims, 3 Drawing Sheets

CURRENT-LIMITING CIRCUITRY

BACKGROUND OF THE INVENTION

1. Field of the Invention

The invention relates to integrated circuits, and in a particular example to a field effect transistor driver circuit with overcurrent protection.

2. Related Art

Modern power circuits typically incorporate one or more power transistors that are regulated to provide desired voltage and current outputs. Typically, such power transistors are field effect transistors (FETs) that are controlled by dedicated FET driver circuits.

For example, a low dropout voltage regulator (LDO) is a circuit used to minimize the difference between an input supply voltage and a regulated output voltage provided by a FET power transistor, in particular an NMOS power transistor. FIG. 1 shows an LDO 180 that includes an LDO input terminal 181, a sense resistor RS1, an NMOS power transistor Q182, output resistors RH1 and RL1, and a conventional FET driver circuit 100. Sense resistor RS1, power transistor Q182, output resistor RH1, and output resistor RL1 are serially connected between input terminal 181 and ground, and a load 190 is coupled to receive an output voltage VOUT from the source of power transistor Q182.

To ensure that the desired output voltage is provided by power transistor Q182, FET driver circuit 100 includes an error amplifier 110 and a bandgap reference 130. Bandgap reference 130 provides a reference voltage to the non-inverting input of error amplifier 110, while the output of error amplifier 110 is connected to the gate of NMOS power transistor 182. Meanwhile, the inverting input of error amplifier 110 is connected to a node A1 at the junction between output resistors RH1 and RL1.

Output resistors RH1 and RL1 form a voltage divider that is part of a feedback loop 102 for error amplifier 110. This feedback loop causes error amplifier 110 to adjust the gate voltage of transistor Q182 until the voltage at node A1 matches the voltage provided by bandgap reference 130. Therefore, a desired value for output voltage VOUT can be set by properly sizing output resistors RH1 and RL1.

To prevent excessive current flow through power transistor Q182 (and potentially through load 190), FET driver circuit 100 also includes a current limiting amplifier 120, a resistor R101, a current source CS11, and an NMOS control transistor Q102. Resistor R101 is connected between input terminal 181 and current source CS11, while control transistor Q102 is connected between the output of error amplifier 110 and ground. The inverting and non-inverting inputs of current limiting amplifier 120 are coupled to the output terminals (i.e., the terminals downstream in the nominal current path) of resistors RS1 and R101, respectively. Finally, the output of current limiting amplifier is connected to the gate of control transistor Q102.

Current source CS11 pulls a constant current through transistor R101, thereby creating a reference voltage drop between input terminal 181 and the non-inverting input of current limiting amplifier 120. The resistance of sense resistor RS1 is selected such that when the current flow through power transistor Q182 reaches a predetermined threshold (called an "overcurrent condition" herein), the voltage drop across sense resistor RS1 is greater than the reference voltage drop across resistor R101. Prior to the current flow through power transistor Q182 reaching the predetermined threshold, the voltage drop across resistor R101 is greater than the voltage drop across resistor RS1.

During normal operation of LDO 180 (i.e., non-overcurrent conditions), when the voltage drop across sense resistor RS1 is less than the voltage drop across resistor R101, the voltage at the inverting input of current limiting amplifier 120 is greater than the voltage at the non-inverting input of current limiting amplifier. Consequently, during normal operation, current limiting amplifier 120 generates a LOW output signal that keeps NMOS control transistor Q102 in an off state. The output of error amplifier 110 therefore controls power transistor Q182 by providing a voltage to the gate of power transistor Q182, and hence, controls the output of LDO 180.

However, as the current flow through power transistor Q182 approaches the threshold current (i.e., the overcurrent condition), the voltage drop across sense resistor RS1 begins to approach the reference voltage drop across resistor R101, which causes the output of current limiting amplifier 120 to being switching to a HIGH output. At the threshold, the voltage output from current limiting amplifier 120 is sufficient to turn on control transistor Q102, which pulls the output of error amplifier 110 towards ground, thereby turning off power transistor Q182 and reducing the output current flow. In this manner, conventional FET driver circuit 100 provides a simple control circuit for power transistor Q182 that includes overcurrent protection.

Unfortunately, the overcurrent protection provided by conventional FET driver circuit 100 can create undesirable output instability. Specifically, as current limiting amplifier 120 turns off NMOS power transistor Q182 in response to an overcurrent situation, the voltage at node A1, and therefore the voltage at the inverting input of error amplifier 110, decreases. However, the voltage provided by bandgap reference 130 to the non-inverting input of error amplifier 110 remains constant at the bandgap voltage. Therefore, error amplifier 110 will attempt to increase its output voltage, which is provided to the gate voltage provided to power transistor Q182, even as current limiting amplifier 120 is trying to reduce that gate voltage (via transistor Q102) in response to the overcurrent situation. This conflict between error amplifier 110 and current limiting amplifier 120 can lead to problematic oscillations of output voltage VOUT of LDO 180.

Accordingly, it is desirable to provide an improved method and apparatus for providing overcurrent protection.

SUMMARY OF THE INVENTION

According to an embodiment of the invention, a FET driver circuit includes an error amplifier for driving a FET, a circuit for providing a reference voltage to the error amplifier, and a current limiting amplifier for preventing excessive current flow through the FET. A feedback loop coupled between an output of the FET and an input of the error amplifier allows the error amplifier to control the FET to produce a desired output voltage.

Meanwhile, the current limiting amplifier compares a voltage drop across a sense resistor in the path of the FET with a reference voltage drop. If the voltage drop across the sense resistor exceeds the reference voltage drop, the current limiting amplifier generates an overcurrent signal. The overcurrent signal is used, in a coordinated fashion, both to reduce the voltage provided to the FET, thereby reducing the FET output, and to reduce the reference voltage provided to the input of the error amplifier, thereby preventing open loop (unstable) conditions within the FET driver circuit.

In one embodiment, the reference voltage provided to the error amplifier is originated in a reference voltage generator circuit that includes a bandgap reference circuit and is provided to the error amplifier through a buffer. In an overcurrent condition, the reference voltage provided to the error amplifier may be reduced by pulling either or both the input and the output of the buffer to ground.

According to another embodiment of the invention, a low dropout voltage regulator (LDO) incorporating the FET driver circuit of the invention can be used to regulate the output of a switching regulator. Rather than use large numbers of capacitors at the output of the switching regulator, an LDO (or group of LDOs) can be used to eliminate the ripple inherent in the output of conventional switching regulators. An additional benefit is the robust overcurrent protection provided by the current limiting circuitry in the LDO(s).

These and other aspects of the invention will be more fully understood in view of the following description of the exemplary embodiments and the drawings thereof.

DETAILED DESCRIPTION

Figure 2A:
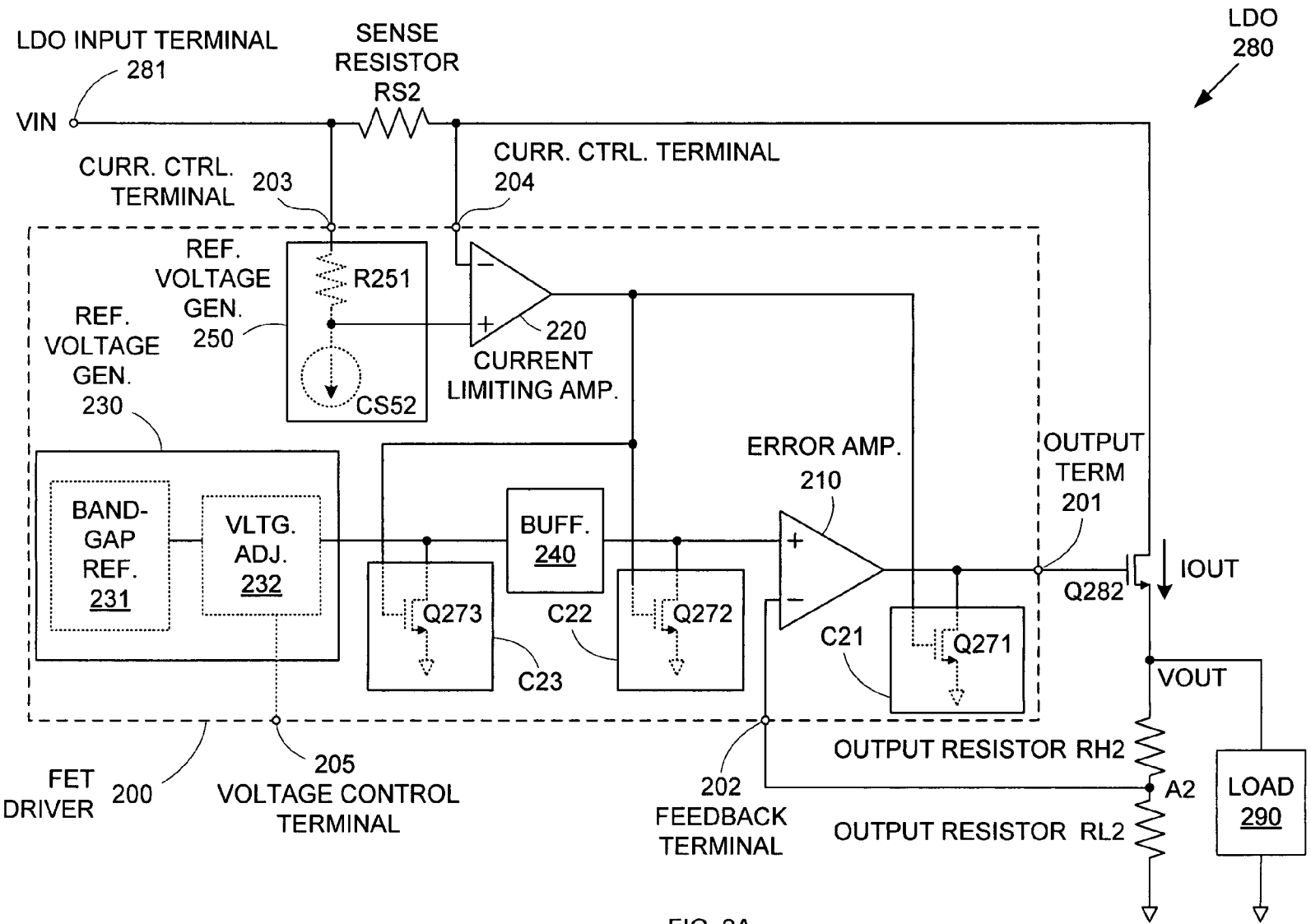
FIG. 2A is a schematic diagram of an LDO that includes a FET driver circuit with overcurrent protection, in accordance with an embodiment of the invention.

FIG. 2A shows an LDO 280 in accordance with an embodiment of the invention. LDO 280 includes a LDO input terminal 281, a sense resistor RS2, a pass device, which in this case is an NMOS power transistor Q282, output resistors RH2 and RL2, and a FET driver circuit 200 with overcurrent protection in accordance with an embodiment of the invention. Sense resistor RS2, power transistor Q282, output resistor RH2, and output resistor RL2 are serially connected between LDO input terminal 281 and ground. FET driver circuit 200 controls power transistor 282 so that an input voltage VIN at LDO input terminal 281 is regulated down to a desired voltage VOUT that is supplied to a load 290 at the source of power transistor Q282. Note that, "ground" voltage can refer to any supply voltage lower than input voltage VIN.

FET driver circuit 200 includes an output terminal 201, a feedback terminal 202, current control terminals 203 and 204, an optional voltage control terminal 205, an error amplifier 210, a current limiting amplifier 220, a reference voltage generator circuit 230, a buffer 240, an reference voltage generator circuit 250, output adjustment circuit C21, and pulldown circuits C22 and C23. According to an embodiment of the invention, error amplifier 210 may be a high speed amplifier.

Note that, according to another embodiment of the invention, FET driver circuit 200 can comprise an individual integrated circuit (IC) (as indicated by the dashed lines), and the remainder of LDO 280 may be integrated into one or more additional ICs (load 290 is typically external to LDO 280). According to various other embodiments of the invention, FET driver circuit 200 can be incorporated into a larger IC (e.g., all of LDO 280 could be fabricated on a single chip).

Within FET driver circuit 200, reference voltage generator circuit 230 produces a reference voltage that is buffered by buffer 240 and provided to the non-inverting input of error amplifier 210. Meanwhile, the output of error amplifier 210 is coupled to output terminal 201, which is in turn connected to the gate of power transistor Q282. Finally, the inverting input of error amplifier 210 is connected to the junction of output resistors RH2 and RL2 (node A2) via feedback terminal 202, thereby forming a feedback loop for controlling an output voltage VOUT and an output current IOUT at the output of power transistor Q282 (in this case, the source of power transistor Q282). The scaled output voltage of power transistor Q282 is sensed by error amplifier 210 (via feedback terminal 202) through the resistive divider formed by output resistors RH2 and RL2. The resistance values of output resistors RH2 an RL2 therefore set a nominal value for output voltage VOUT. Note that, the scaled output of power transistor Q282 can be the actual output of power transistor Q282 (i.e., scale factor equal to one).

According to an embodiment of the invention, reference voltage generator circuit 230 can provide a fixed reference voltage to error amplifier 210 (via buffer 240), so that the value of output voltage VOUT is determined solely by the values of output resistors RH2 and RL2. For example, reference voltage generator circuit 230 can include a bandgap reference 231 and a voltage adjuster 232, with voltage adjuster 232 applying a fixed scaling factor to the bandgap voltage provided by bandgap reference 231. However, adjusting the values of output resistors RH2 and RL2 could affect the performance of LDO 280 (due to gain-bandwidth changes).

Therefore, according to another embodiment of the invention, the scaling factor provided by voltage adjuster 232 is controllable via voltage control terminal 205. For example, voltage adjuster 232 could comprise a voltage divider formed from a fixed resistor and a variable resistor, with the resistance of the variable resistor being set by a signal provided to voltage control terminal 205. Since the output of reference voltage generator circuit 230 is buffered by buffer 240 before being provided to error amplifier 210, the use of a variable voltage adjuster 232 allows output voltage VOUT to be changed without affecting the performance of LDO 280.

Reference voltage generator circuit 230 is coupled to error amplifier 210 by buffer 240 so that both inputs of error amplifier 210 see the same impedance. In particular, the impedance seen by the inverting input of error amplifier 210 low, because the inverting input is coupled to node A1 at the junction between output resistors RH2 and RL2, which typically have low resistances to minimize the effect of those output resistors on output voltage VOUT. By contrast, if buffer 240 were omitted, the non-inverting input of error amplifier 210 would see the high output impedance of reference voltage generator circuit 230. Buffer 240 acts as an impedance converter that allows the non-inverting input of error amplifier 210 to see a low impedance similar to that seen by the inverting input, thereby preventing a problematic offset voltage from appearing between the two inputs of error amplifier 210.

Overcurrent protection for FET driver circuit 200 is provided by current limiting amplifier 220, reference voltage generator circuit 250, output adjustment circuit C21, and pulldown circuits C22 and C23. Current control terminal 203 is coupled to the non-inverting input of current limiting amplifier 220 by reference voltage generator circuit 250, while current control terminal 204 is directly connected to the inverting input of current limiting amplifier 220. Reference voltage generator circuit 250 applies a predetermined reference voltage drop between current control terminal 203 and the non-inverting input terminal of current limiting amplifier 220.

Reference voltage generator circuit 250 can comprise any circuit for applying the reference voltage drop to the voltage at current control terminal 203. For example, reference voltage generator circuit 250 can include a resistor R251 coupled between current control terminal 203 and a current source CS52. Current source CS52 sinks a constant current through resistor R251 to create the reference voltage drop. Therefore, since the non-inverting input of current limiting amplifier 220 is coupled to the output terminal of resistor R251 (i.e., at the junction between resistor R251 and current source CS52), the voltage at the non-inverting input of current limiting amplifier 220 is equal to input voltage VIN minus the reference voltage drop.

Meanwhile, because current control terminal 204 is connected to the output terminal of sense resistor RS2 for current flow in the nominal current direction, the voltage at the inverting input of current limiting amplifier 220 is equal to input voltage VIN minus the voltage drop across sense resistor RS2. Current limiting amplifier 220 is therefore configured to compare the voltage drop across sense resistor RS2 to the reference voltage drop provided by reference voltage generator circuit 250. By properly sizing sense resistor RS2, excessive output current levels can be detected by current limiting amplifier 220.

Specifically, sense resistor RS2 can be sized such that when output current IOUT through power transistor Q282 is equal to a desired threshold current (i.e., the maximum allowable current), the voltage drop across sense resistor RS2 is equal to the reference voltage drop provided by reference voltage generator circuit 250. Thus, during normal operations when output current IOUT is less than the threshold current (i.e., not in an overcurrent condition), the voltage drop across sense resistor RS2 is less than the reference voltage drop provided by reference voltage generator circuit 250. Accordingly, the voltage at the non-inverting input of current limiting amplifier 220 (i.e., VIN minus the reference voltage drop) is greater than the voltage at the inverting input of current limiting amplifier 220 (i.e., VIN minus the voltage drop across RS2). Under these normal operating conditions, the output of current limiting amplifier 220 is relatively low, and hence output adjustment circuit C21 and pulldown circuits C22 and C23 have minimal effect on the operation of FET driver circuit 200.

However, if output current IOUT exceeds the threshold current (an overcurrent condition), the voltage drop across sense resistor RS2 is larger than the reference voltage drop provided by reference voltage generator circuit 250, so that the voltage at the inverting input of current limiting amplifier 220 is less than the voltage at the non-inverting input. The resulting overcurrent signal output by current limiting amplifier 220 in response to the overcurrent condition becomes sufficiently high enough to cause output adjustment circuit C21 to adjust the voltage at output terminal 201 towards the shutoff voltage of power transistor Q282 (i.e., the gate voltage that causes power transistor Q282 to be turned off). As a result, power transistor Q282 is turned off (either partially or fully), thereby reducing output current IOUT to manage the overcurrent condition. The voltage signal output by current limiting amplifier 220 is also provided to pulldown circuits C22 and C23, which are driven thereby to further assist in managing the overcurrent condition, as described in greater detail below.

Output adjustment circuit C21 can comprise any circuit for adjusting the voltage at the output of error amplifier 210 towards the shutoff voltage of power transistor Q282 in response to the overcurrent signal from current limiting amplifier 220. In the exemplary embodiment shown in FIG. 2A, this means reducing the voltage at the output of error amplifier 210 to turn off (partially or fully) NMOS power transistor Q282. Accordingly, output adjustment circuit C21 can comprise an NMOS transistor Q271 coupled between the output of error amplifier 210 and ground, with the output of current limiting amplifier 220 being coupled to the gate of transistor Q271. During normal operation (i.e., the voltage drop across sense resistor RS2 is less than the voltage provided by reference voltage generator 250), the output voltage of current limiting amplifier 220 is relatively low, and therefore keeps NMOS transistor Q271 turned off. Consequently, transistor Q271 does not affect the output of error amplifier 210 during normal operating conditions.

However, during an overcurrent condition, the output voltage of current limiting amplifier 220 transitions to a relatively high level. This relatively high output voltage from current limiting amplifier 220 acts as an overcurrent signal that turns NMOS transistor Q271 on, which in turn creates (increases) a conductive path between the output of error amplifier 210 and ground. The output voltage of error amplifier 210 (and hence the output of FET driver circuit 200) is therefore pulled down, thereby reducing the gate voltage of power transistor Q282 and preventing excessive current flow.

Note that, the larger the voltage signal output by current limiting amplifier 220, the larger the conductive path provided by transistor Q271 (until the channel is pinched off and transistor Q271 is saturated), so that the output of error amplifier 210 is pulled more strongly to ground for larger overcurrent conditions. Note further that, while a single NMOS transistor Q271 is depicted for exemplary purposes, various other implementations of output adjustment circuit C21 will be readily apparent.

Pulldown circuits C22 and C23 serve to maintain signal stability at the output of error amplifier 210. Specifically, during an overcurrent condition, pulldown circuits C22 and C23 provide conductive paths to ground at the non-inverting input of error amplifier 210 and the input of buffer 240, respectively.

Figure 1:
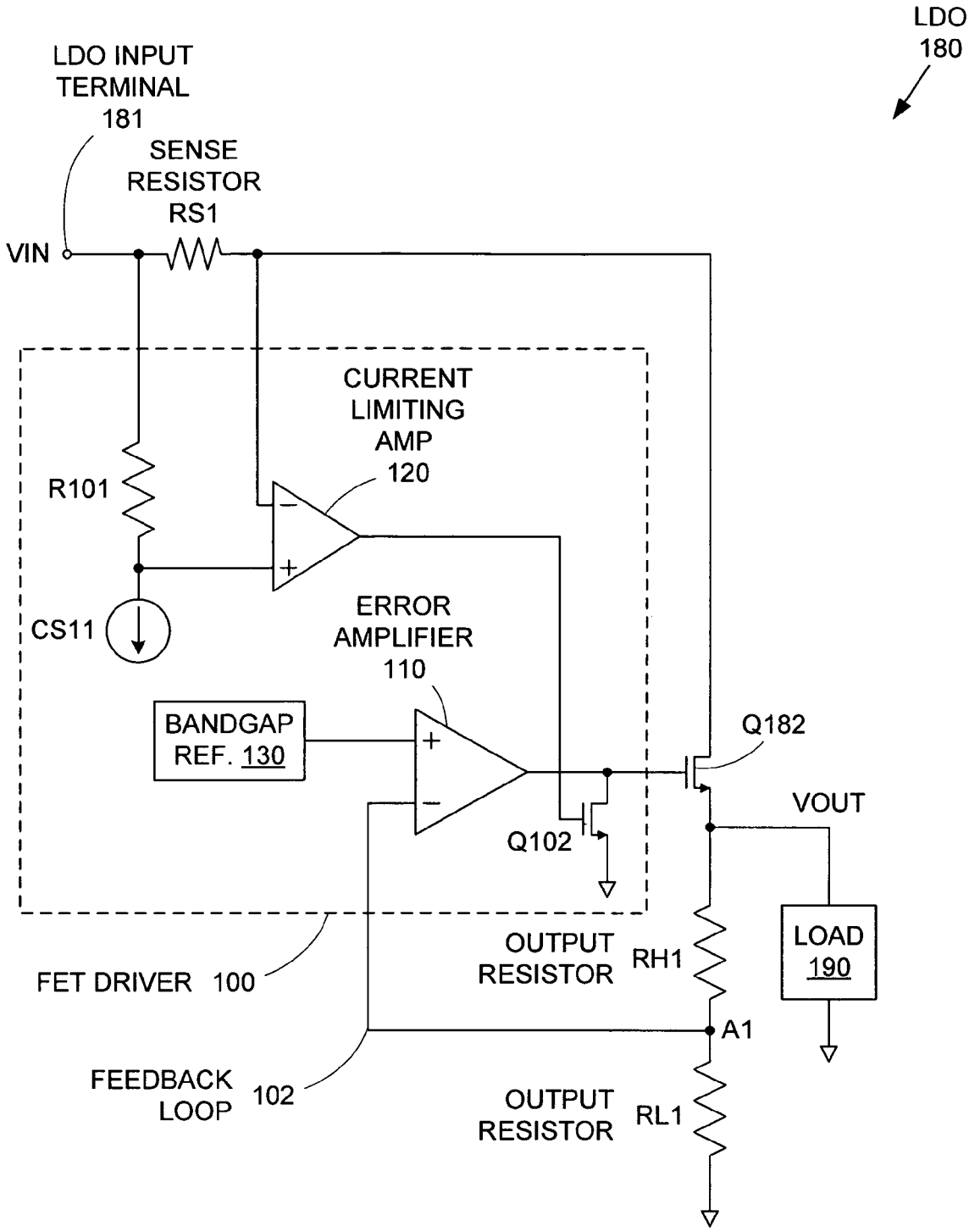
FIG. 1 (PRIOR ART)
FIG. 1 is a schematic diagram of an LDO that includes a conventional FET driver circuit.

Therefore, at the same time that output adjustment circuit C21 is turning off power transistor Q282, thereby reducing the voltage at the inverting input of error amplifier 210, pulldown circuit C22 is reducing the voltage at the non-inverting input of error amplifier 210. In this manner, pulldown circuit C22 minimizes any differential voltage that might appear across the inverting and non-inverting inputs of error amplifier 210 during an overcurrent condition. As a result, the problematic output oscillations caused by conventional current limiting circuits (such as described with respect to FIG. 1) are substantially eliminated.

In a similar manner, pulldown circuit C23 prevents a differential voltage from appearing across the input and output of buffer 240. Since a buffer always attempts to provide an output voltage that is equal to its input voltage, any input-output voltage differential could result in problematic output voltage oscillations from buffer 240. Therefore, pulldown circuit C23 provides a voltage at the input of buffer 240 that is equal to the voltage provided at the output of buffer 240 by pulldown circuit C22, thereby ensuring that a unity gain is maintained across the input and output of buffer 240.

According to an embodiment of the invention, pulldown circuits C22 and C23 can comprise NMOS transistors Q272 and Q273, respectively. Transistor Q272 is coupled between the non-inverting input of error amplifier 210 and ground, while transistor Q273 is coupled between the input of buffer 240 and ground. The gates of transistors Q272 and Q273 are both coupled to the output of current limiting amplifier 220, and hence are controlled by the voltage signal output by current limiting amplifier 220.

During normal operating conditions, current limiting amplifier 220 provides a relatively low output voltage (since the voltage drop across sense resistor RS2 is less than the voltage provided by reference voltage generator 250) that turns both transistors Q272 and Q273 off. Therefore, pulldown circuits C22 and C23 have no effect on the operation of FET driver circuit 200. However, during an overcurrent condition, the output voltage of current limiting amplifier 220 switches to a relatively high state that turns transistors Q272 and Q273 on, thereby creating conductive paths to ground that pull down the voltages at the non-inverting input of error amplifier 210 and the input of buffer 240, respectively.

In this manner, pulldown circuits C22 and C23 prevent problematic voltage differentials from appearing across the inputs of error amplifier 210 and across the input and output of buffer 240. Note that, while a single NMOS transistor Q272 is depicted for pulldown circuit C22 for exemplary purposes, and a single NMOS transistor Q273 is depicted for pulldown circuit C23 for exemplary purposes, various other implementations of pulldown circuits C22 and C23 will be readily apparent.

Note also that, while current limiting amplifier 220 is configured such that the output of current limiting amplifier is relatively low during normal operation and relatively high during overcurrent conditions, according to various other embodiments of the invention, the polarity of current limiting amplifier 220 could be reversed (i.e., the non-inverting input coupled to the output terminal of sense resistor RS2). Current limiting amplifier 220 would then provide a relatively high normal operation voltage and a relatively low overcurrent condition voltage (with output adjustment circuit C21 and pulldown circuits C22 and C23 being configured to provide the appropriate voltage lowering action in response to relatively low overcurrent output voltage from current limiting amplifier 220).

Figure 2B:
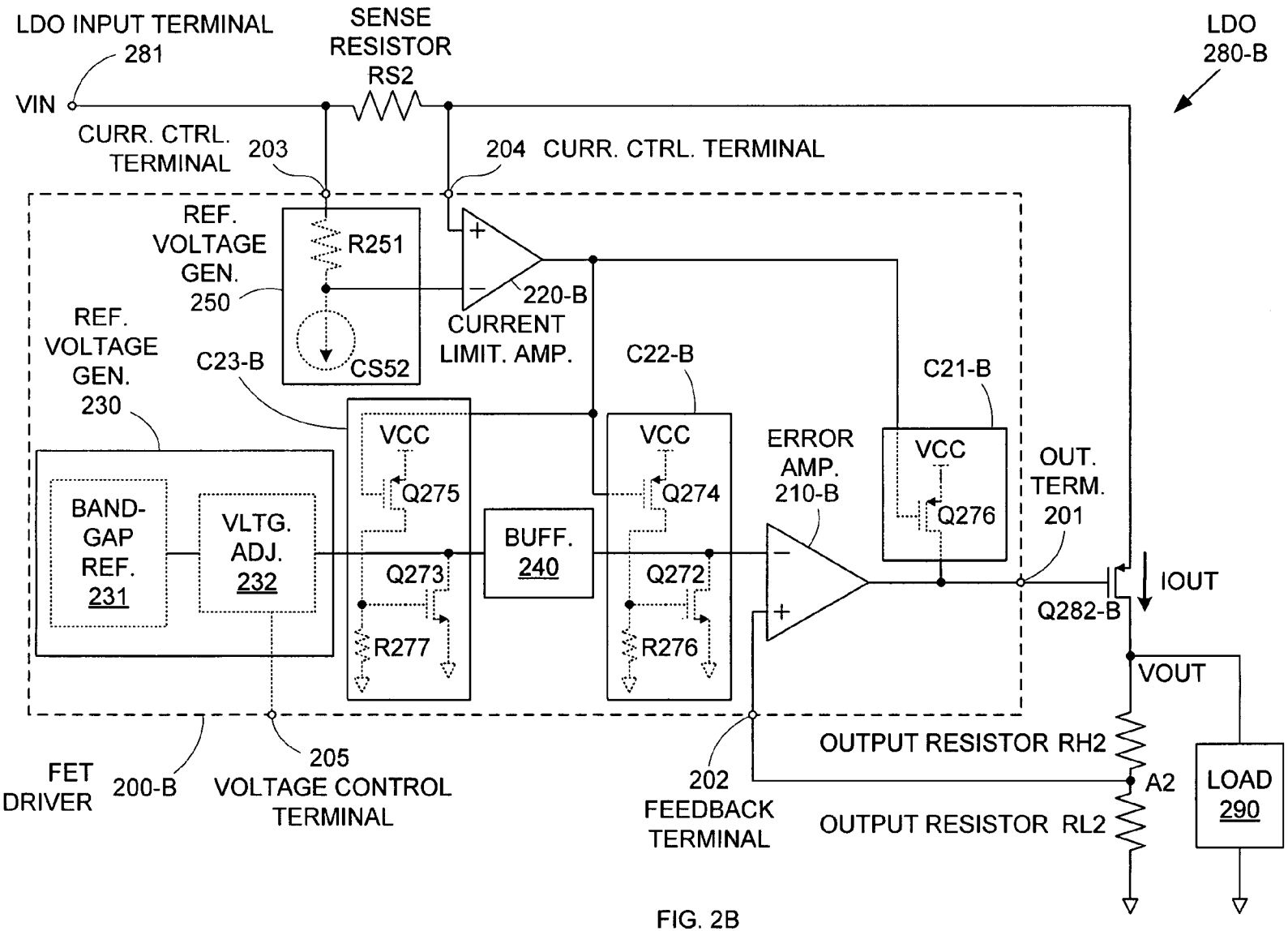
FIG. 2B is a schematic diagram of an LDO that includes a FET driver circuit with overcurrent protection, in accordance with another embodiment of the invention.

Note further that, while FET driver circuit 200 is depicted and described as driving an NMOS transistor for exemplary purposes, a FET driver circuit in accordance with the invention can drive a PMOS transistor or any other type of FET device. For example, FIG. 2B shows a schematic diagram of an LDO 280-B that includes a FET driver circuit 200-B, according to another embodiment of the invention. FET driver circuit 200-B is substantially similar to FET driver circuit 200 shown in FIG. 2A, except that FET driver circuit 200-B is configured to drive a PMOS power transistor Q282-B.

For example, if the polarity of an error amplifier 210-B in FET driver circuit 200-B is reversed (compared to error amplifier 210 in FET driver circuit 200), then positive feedback may be used to regulate the output of error amplifier 210-B so that appropriate gate control is provided to PMOS power transistor Q282-B. Relatedly, because the shutoff voltage of PMOS power transistor Q282-B is the positive supply voltage, output adjustment circuit C21-B is configured to pull the output of error amplifier 210-B towards the positive supply voltage in response to an overcurrent condition output from current limiting amplifier 220.

In this manner, PMOS power transistor Q282-B is turned off during an overcurrent condition to prevent excessive output current flow. Because this results in the scaled output voltage of power transistor Q282-B (which is sensed at the non-inverting input of error amplifier 210-B) decreasing as well, pulldown circuits C22-B and C23-B must still provide conductive paths to ground in response to the overcurrent condition output of current limiting amplifier 220 (similar to pulldown circuits C22 and C23 shown in FIG. 2A).

Note that, just as described with respect to FET driver circuit 200, current limiting amplifier 220-B can take any polarity, depending on the structure of output adjustment circuit C21-B and pulldown circuits C22-B and C23-B. For exemplary purposes, FIG. 2B depicts the non-inverting input of current limiting amplifier being coupled to the output terminal of sense resistor RS2 (via current control terminal 204). As a result, current limiting amplifier 220-B provides a relatively high normal operation signal and a relatively low overcurrent signal.

Accordingly, the exemplary implementations of output adjustment circuit C21-B and pulldown circuits C22-B and C23-B (indicated by the dotted lines) are configured to affect the behavior of FET driver circuit 200-2 only in response to a relatively low voltage signal output by current limiting amplifier 220-B. For example, output adjustment circuit C21-B includes a PMOS transistor Q276 coupled between an upper supply voltage VCC and the output of error amplifier 210-B. The gate of transistor Q276 is coupled to the output of current limiting amplifier 220-B.

The relatively high voltage output by current limiting amplifier 220-B during normal operation of FET driver circuit 200-B will therefore keep PMOS transistor Q276 turned off, which allows the output of error amplifier 210-B to control power transistor Q282-B. However, during an overcurrent condition, the relatively low overcurrent signal from current limiting amplifier 220-B turns transistor Q276 on, thereby creating a conductive path to upper supply voltage VCC that raises the output voltage of FET driver circuit 200-B and turns off (partially or fully) power transistor Q282-B to terminate the overcurrent condition.

Meanwhile, because current limiting amplifier 220-B provides a relatively low overcurrent condition output, pulldown circuit C22-B includes a PMOS transistor Q274, an NMOS transistor Q272, and a resistor R276. NMOS transistor Q272 is coupled between the inverting input of error amplifier 210-B and ground, while PMOS transistor Q274 is coupled between upper supply voltage VCC and the gate of NMOS transistor Q272. The gate of PMOS transistor Q274 is coupled to the output of current limiting amplifier 220-B, while the gate of transistor Q272 is coupled to ground by resistor R276.

In response to the relatively high normal operation signal from current limiting amplifier 220-B, PMOS transistor Q274 is turned off, so that the gate of NMOS transistor Q272 is pulled to ground via resistor R276. Transistor Q272 is therefore turned off, so that pulldown circuit C22-B does not affect the voltage provided to the non-inverting input of error amplifier 210-B.

However, in response to the relatively low overcurrent signal from current limiting amplifier 220-B, PMOS transistor Q274 turns on and pulls the gate of NMOS transistor Q272 towards upper supply voltage VCC. As a result, NMOS transistor Q272 begins to turn on, thereby creating a conductive path to ground that pulls down the voltage at the inverting input of error amplifier 210-B. Since the scaled output voltage provided to the non-inverting input of error amplifier 210-B is also pulled down during an overcurrent condition (as a result of output adjustment circuit C21-B turning off power transistor Q282-B), the voltage differential across the inputs of error amplifier 210-B is minimized, thereby ensuring a stable output.

Similarly, pulldown circuit C23-B includes a PMOS transistor Q275, an NMOS transistor Q273, and a resistor R277. NMOS transistor Q273 is coupled between the input of buffer 240 and ground, while PMOS transistor Q275 is coupled between upper supply voltage VCC and the gate of NMOS transistor Q273. The gate of PMOS transistor Q275 is coupled to the output of current limiting amplifier 220-B, while the gate of transistor Q273 is coupled to ground by resistor R277.

In response to the relatively high normal operation signal from current limiting amplifier 220-B, PMOS transistor Q275 is turned off, so that the gate of NMOS transistor Q273 is pulled to ground via resistor R277. Transistor Q273 is therefore turned off, so that pulldown circuit C23-B does not affect the voltage at the input of buffer 240.

However, in response to the relatively low overcurrent signal current limiting amplifier 220-B, PMOS transistor Q275 turns on and pulls the gate of NMOS transistor Q273 towards upper supply voltage VCC. As a result, NMOS transistor Q273 begins to turn on, thereby creating a conductive path to ground that pulls down the voltage at the input of buffer 240. Since pulldown circuit C22-B is simultaneously reducing the voltage at the output of buffer 240, a one-to-one ratio is maintained across the input and output of buffer 240, thereby preventing buffer output oscillations.

Practitioners will appreciate that the invention goes beyond the embodiments set forth above. For instance, it is not necessary that the pass device that provides the regulated output voltage and current be a FET transistor such as NMOS transistor Q282 shown in FIG. 2A or PMOS transistor Q282-B shown in FIG. 2B. According to various other embodiments of the invention, the pass device could be a bipolar transistor, or any other type of transistor or circuit that includes a control terminal (e.g., base or gate) coupled to receive the output of error amplifier 210.

Further, the exemplary embodiments described above teach that, where two (or more) amplifiers tend to drive an output terminal in different directions, system stability may be maintained by having a first one of the amplifiers (e.g., current limiting amplifier 220) also control an input of a second one of the amplifiers (e.g., error amplifier 210). Specifically, the circuit depicted in FIG. 2A harmonizes the outputs of the first and second amplifiers by having the first amplifier adjust an input of the second amplifier to cause the output of the second amplifier to match the output of the first amplifier (at the output terminal).

For example, in FIG. 2A, current limiting amplifier 220 drives output terminal 201 to a relatively low voltage by providing an overcurrent condition signal to output adjustment circuit C21. Absent pulldown circuits C22 and C23, error amplifier 210 would provide a competing relatively high voltage at output terminal 201 (as NMOS transistor Q282 is turned off). Pulldown circuits C22 and C23 avoid this output conflict by concurrently adjusting the voltage at the non-inverting input of error amplifier 210 to cause error amplifier 210 to provide a relatively low output voltage (in this case lowering the voltage at the non-inverting input of error amplifier 210).

Note also that, according to another embodiment of the invention, the pulldown circuit C22 at the junction between the output terminal of buffer 240 and the input terminal of error amplifier 210 could be removed, leaving only pulldown circuit C23 at the input terminal of buffer 240. During an overcurrent condition, pulldown circuit C23 would reduce the voltage at the input terminal of buffer 240, thereby reducing the voltage at the output terminal of buffer 240 (and hence at the non-inverting input of error amplifier 210). Typically, such an implementation would be acceptable so long as propagation delays through buffer 240 would not overly delay the overcurrent condition response provided to the input of error amplifier 210.

Note further that, if a FET driver circuit in accordance with the invention does not include a buffer between the reference voltage generator and the input of the error amplifier (e.g., reference voltage generator circuit 230 coupled directly to error amplifier 210), a single pulldown circuit could be used to prevent signal competition at the output of the error amplifier. For example, in FIG. 2A, the removal of buffer 240 would allow pulldown circuit C23 to be removed, leaving only pulldown circuit C22 to adjust the voltage at the non-inverting input of error amplifier 210 during overcurrent conditions.

The various embodiments of the structures and methods of this invention that are described above are illustrative only of the principles of this invention and are not intended to limit the scope of the invention to the particular embodiments described. For example, an LDO incorporating FET driver circuit 200, as shown in FIG. 2A, or FET driver circuit 200-B, as shown in FIG. 2B, can also be part of a larger voltage regulation circuit. Thus, the invention is limited only by the following claims and their equivalents.

What is claimed is:

1. A circuit for controlling a pass device, the circuit comprising:

an error amplifier for generating a first control signal;

a current limiting amplifier for generating a second control signal;

a first control circuit for adjusting a voltage at an output terminal of the error amplifier towards a shutoff voltage of the pass device in response to the second control signal;

a second control circuit for adjusting a voltage at a first input terminal of the error amplifier to cause the error amplifier to adjust the first control signal towards the shutoff voltage of the pass device in response to the second control signal.

2. The circuit of claim 1, wherein the second control circuit is coupled to the first input terminal of the error amplifier.

3. The circuit of claim 2, further comprising:

a buffer, an output terminal of the buffer being coupled to the first input terminal of the error amplifier; and a third control circuit for adjusting a voltage at an input terminal of the buffer to maintain a unity gain across the buffer in response to the second control signal.

4. The circuit of claim 1, further comprising a buffer, wherein an output terminal of the buffer is coupled to the first input terminal of the error amplifier, and wherein the second control circuit is coupled to an input terminal of the buffer.

5. The circuit of claim 1, wherein the pass device comprises a field effect transistor (FET).

6. The circuit of claim 1, further comprising:

a first control terminal coupled to a first input terminal of the current limiting amplifier;

a second control terminal; and an reference voltage generator circuit for applying a predetermined voltage drop between the second current control terminal and a second input terminal of the current limiting amplifier.

7. The circuit of claim 1, further comprising a reference voltage generator circuit comprising:

a bandgap reference generator for generating a bandgap voltage; and a voltage adjustment circuit for applying a scale factor to the bandgap voltage to generate a reference voltage at an output terminal of the reference voltage generator circuit, the output terminal of the reference voltage generator circuit being coupled to the first input terminal of the error amplifier.

8. The circuit of claim 7, further comprising a voltage control terminal for receiving a voltage control signal for adjusting the scale factor applied to the bandgap voltage by the voltage adjustment circuit.

9. A method for controlling a pass device, the method comprising:

providing a first input voltage to a first input terminal of an error amplifier;

providing a scaled output of the pass device to a second input terminal of the error amplifier to generate a control signal at an output terminal of the error amplifier, the output terminal of the error amplifier being coupled to a control terminal of the pass device;

generating an overcurrent signal when an overcurrent condition through the pass device is detected;

adjusting a first voltage at the control terminal of the pass device towards a shutoff voltage of the pass device in response to the overcurrent signal; and adjusting the first input voltage to cause the error amplifier to adjust the control signal towards the shutoff voltage of the pass device in response to the overcurrent signal.

10. The method of claim 9, wherein providing the first input voltage comprises:

generating a reference voltage at an output terminal of a reference voltage generator, the output terminal of the reference voltage generator being coupled to the first input terminal of the error amplifier by a buffer;

adjusting a voltage at an input terminal of the buffer to maintain a unity gain across the buffer in response to the overcurrent signal.

11. The method of claim 10, wherein generating the reference voltage comprises applying a scale factor to a bandgap reference voltage, the scale factor being controlled by a voltage control signal.

12. The method of claim 9, wherein generating the overcurrent signal comprises:

providing a sense resistor in series with the pass device;

coupling an output terminal of the sense resistor to a first input terminal of a current limiting amplifier; and providing an offset voltage circuit to apply a predetermined voltage drop between an input terminal of the sense resistor and a second input terminal of the current limiting amplifier, wherein the predetermined voltage drop is substantially equal to a threshold current multiplied by a resistance of the sense resistor.

13. The method of claim 9, wherein adjusting the first voltage at the control terminal of the pass device comprises:

providing a transistor between the control terminal and a supply voltage terminal; and turning on the transistor in response to the overcurrent signal.

14. A low dropout voltage regulator (LDO) comprising:

a pass device;

an error amplifier comprising a first input terminal coupled to receive a first input voltage, a second input terminal coupled to receive a scaled output of the pass device, and an output terminal coupled to a control terminal of the pass device;

a current limiting amplifier for generating an overcurrent signal when a current through the pass device reaches a threshold current;

an output adjustment circuit for adjusting a first voltage at the control terminal of the pass device towards a shutoff voltage of the pass device in response to the overcurrent signal; and a first pulldown circuit for adjusting a the first input voltage to cause the error amplifier to adjust the first control signal towards the shutoff voltage of the pass device in response to the second control signal.

15. The LDO of claim 14, further comprising:

a sense resistor, wherein an output terminal of the sense resistor is coupled to a first input terminal of the current limiting amplifier; and an reference voltage generator circuit, the reference voltage generator circuit applying a predetermined voltage drop between an input terminal of the sense resistor and a second input terminal of the current limiting amplifier.

16. The LDO of claim 15, wherein the predetermined reference drop is substantially equal to a resistance of the sense resistor multiplied by the threshold current.

17. The LDO of claim 14, wherein the first pulldown circuit is coupled to the first input terminal of the error amplifier, the LDO further comprising:

a buffer, an output terminal of the buffer being coupled to the first input terminal of the error amplifier; and a second pulldown circuit for maintaining a unity gain across the buffer in response to the overcurrent signal, the second pulldown circuit being coupled to an input terminal of the buffer.

18. The LDO of claim 17, further comprising a reference voltage generator for providing a reference voltage to the input terminal of the buffer.

19. The LDO of claim 18, wherein the reference voltage generator comprises:

a bandgap reference generator for generating a bandgap reference voltage;

a voltage scaling circuit for applying a scale factor to the bandgap reference voltage to generate the reference voltage; and a voltage control terminal for receiving a voltage control signal, the voltage control signal controlling the scale factor applied by the voltage scaling circuit.

* * * * *